US008782851B2

(12) United States Patent
Follows et al.

(10) Patent No.: US 8,782,851 B2
(45) Date of Patent: Jul. 22, 2014

(54) CLEANER HEAD

(75) Inventors: Thomas James Dunning Follows, Malmesbury (GB); Stephen Benjamin Courtney, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 197 days.

(21) Appl. No.: 12/791,574

(22) Filed: Jun. 1, 2010

(65) Prior Publication Data

US 2010/0306959 A1 Dec. 9, 2010

(30) Foreign Application Priority Data

Jun. 9, 2009 (GB) ..... 0909897.1

(51) Int. Cl.

| | |
|---|---|
| ***A47L 5/10*** | (2006.01) |
| ***A47L 5/26*** | (2006.01) |
| ***A47L 9/04*** | (2006.01) |
| ***A46B 13/00*** | (2006.01) |
| ***A46B 15/00*** | (2006.01) |

(52) U.S. Cl.

CPC ..... *A46B 13/005* (2013.01); *A47L 9/0477* (2013.01); *A46B 13/006* (2013.01); *A46B 2200/3033* (2013.01); *A46B 15/0018* (2013.01)

USPC ..... 15/383; 15/1.51; 15/182; 15/141.2; 15/207.2

(58) Field of Classification Search

CPC ..... A47L 5/00; A47L 5/30; A47L 9/0477; A47L 13/40; A46B 13/005; A46B 13/006; A46B 15/0018; A46B 2200/3033; A46B 13/02

USPC ..... 15/1.51, 141.2, 179–183, 198, 200, 15/207.2, 383, 398

See application file for complete search history.

(56) References Cited

U.S. PATENT DOCUMENTS

| | | | | |
|---|---|---|---|---|
| 2,281,863 | A * | 5/1942 | Smellie | 15/183 |
| 2,426,315 | A | 8/1947 | Marick | |
| 2,459,007 | A | 1/1949 | Taylor | |
| 2,578,549 | A | 12/1951 | Hooban | |
| 2,659,921 | A | 11/1953 | Osborn | |
| 3,186,019 | A | 6/1965 | Hattori | |
| 3,614,801 | A | 10/1971 | Peabody | |

(Continued)

FOREIGN PATENT DOCUMENTS

| | | |
|---|---|---|
| CN | 101090660 | 12/2007 |
| DE | 32 05 199 | 8/1983 |

(Continued)

OTHER PUBLICATIONS

Properties of Horsehair found at: http://www.gordonbrush.com/documents/ESDCat-06%20Low%20Res.pdf.*

(Continued)

*Primary Examiner* — Brian Glessner
*Assistant Examiner* — Brian D Mattei
(74) *Attorney, Agent, or Firm* — Morrison & Foerster LLP

(57) ABSTRACT

Agitating apparatus for a surface treating appliance includes a rotatable body having at least one substantially continuous row of bristles extending outwardly therefrom, the bristles having a surface resistivity in the range from $1\times10^{-5}$ to $1\times10^{12}$ Ω/sq so that static electricity residing on a floor surface to be cleaned is discharged upon contact with the bristles.

13 Claims, 7 Drawing Sheets

(56) References Cited

U.S. PATENT DOCUMENTS

| | | | | |
|---|---|---|---|---|
| 3,771,189 | A | 11/1973 | Horton et al. | |
| 3,908,223 | A * | 9/1975 | Brooks et al. | 15/383 |
| 4,186,030 | A | 1/1980 | Armstrong | |
| 4,197,610 | A | 4/1980 | Schneider | |
| 4,435,073 | A | 3/1984 | Miller | |
| 4,706,320 | A * | 11/1987 | Swift | 15/1.51 |
| 4,835,807 | A | 6/1989 | Swift | |
| 5,150,499 | A | 9/1992 | Berfield | |
| 5,187,526 | A | 2/1993 | Zaretsky | |
| 5,339,143 | A | 8/1994 | Kunzmann | |
| 5,452,490 | A * | 9/1995 | Brundula et al. | 15/182 |
| 5,689,791 | A | 11/1997 | Swift | |
| 5,701,633 | A * | 12/1997 | Jonischus | 15/387 |
| 5,905,932 | A * | 5/1999 | Morse et al. | 399/353 |
| 5,916,660 | A * | 6/1999 | Currie et al. | 428/122 |
| 6,199,244 | B1 | 3/2001 | Hilgers et al. | |
| 6,267,660 | B1 * | 7/2001 | Jespersen | 451/550 |
| 6,539,575 | B1 | 4/2003 | Cohen | |
| 2005/0039282 | A1 | 2/2005 | Paterson et al. | |
| 2005/0153558 | A1 | 7/2005 | Koh et al. | |
| 2005/0246857 | A1 * | 11/2005 | Omoto et al. | 15/366 |
| 2008/0000043 | A1 | 1/2008 | Frederickson | |
| 2010/0306956 | A1 | 12/2010 | Follows et al. | |
| 2010/0306957 | A1 | 12/2010 | Follows et al. | |
| 2010/0306958 | A1 | 12/2010 | Follows et al. | |

FOREIGN PATENT DOCUMENTS

| | | |
|---|---|---|
| DE | 3418224 | 11/1984 |
| DE | 43 06 734 | 9/1994 |
| DE | 19547311 | 6/1997 |
| EP | 0 313 403 | 4/1989 |
| EP | 0 992 211 | 4/2000 |
| GB | 734360 | 7/1955 |
| GB | 1360309 | 7/1974 |
| GB | 2090124 | 7/1982 |
| GB | 2 135 869 | 9/1984 |
| GB | 2 150 422 | 7/1985 |
| GB | 2 425 715 | 11/2006 |
| JP | 51-163755 | 12/1976 |
| JP | 5-269059 | 10/1993 |
| JP | 5-317226 | 12/1993 |
| JP | 6-105771 | 4/1994 |
| JP | 7-322 | 1/1995 |
| JP | 7-8425 | 1/1995 |
| JP | 7-327885 | 12/1995 |
| JP | 11-216088 | 8/1999 |
| JP | 2000-60775 | 2/2000 |
| JP | 2000-217753 | 8/2000 |
| JP | 2002-136457 | 5/2002 |
| JP | 2003-52584 | 2/2003 |
| JP | 2003-339590 | 12/2003 |
| JP | 2004-267452 | 9/2004 |
| JP | 2005-66034 | 3/2005 |
| JP | 2005-168796 | 6/2005 |
| JP | 2005-230514 | 9/2005 |
| JP | 2007-313037 | 12/2007 |
| JP | 2009-11374 | 1/2009 |
| WO | WO-99/27834 | 6/1999 |
| WO | WO-2006/080383 | 8/2006 |
| WO | WO-2006/098965 | 9/2006 |
| WO | WO-2009/149722 | 12/2009 |

OTHER PUBLICATIONS

GB Search Report dated Sep. 8, 2009, directed towards counterpart GB Application No. 0909897.1; 2 pages.

PCT International Search Report and Written Opinion mailed Oct. 13, 2010 directed towards international application No. PCT/GB2010/050852; 13 pages.

Follows et al., U.S. Office Action mailed Oct. 4, 2012, directed to U.S. Appl. No. 12/791,659; 13 pages.

Follows et al., U.S. Office Action mailed Nov. 6, 2012, directed to U.S. Appl. No. 12/791,470; 10 pages.

Follows et al., U.S. Office Action mailed Jun. 13, 2012, directed to U.S. Appl. No. 12/791,659; 12 pages.

Follows et al., U.S. Office Action mailed Jun. 13, 2012, directed to U.S. Appl. No. 12/791,640; 12 pages.

Follows et al., U.S. Office Action mailed Jun. 13, 2012, directed to U.S. Appl. No. 12/791,470; 8 pages.

Information on Surface Resistivity; Plastics International.com found on internet wayback machine at: http://web.archive.org/web/20090502001116/http://plasticsintl.com/esd.htm dated Mar. 31, 2009; 2 pages.

Follows et al., U.S. Office Action mailed Mar. 1, 2013, directed to U.S. Appl. No. 12/791,659; 17 pages.

"Polypropylene: Material Information," located at <http://www.goodfellow.com/E/Polypropylene.html> visited on May 23, 2013. (4 pages).

"Polyamide—Nylon 6,6: Material Information," located at <http://www.goodfellowusa.com/A/Polyamide-Nylon-6,-6.html> visited on May 23, 2013. (4 pages).

Follows et al., U.S. Office Action mailed Jun. 27, 2013, directed to U.S. Appl. No. 12/791,659; 17 pages.

Follows et al., U.S. Office Action mailed Nov. 4, 2013, directed to U.S. Appl. No. 12/791,659; 19 pages.

Follows et al., U.S. Office Action mailed Jun. 5, 2013, directed to U.S. Appl. No. 13/759,771; 11 pages.

Follows et al., U.S. Office Action mailed Nov. 6, 2013, directed to U.S. Appl. No. 13/759,771; 12 pages.

* cited by examiner

CLEANER HEAD

REFERENCE TO RELATED APPLICATIONS

This application claims the priority of United Kingdom Application No. 0909897.1, filed Jun. 9, 2009, the entire contents of which are incorporated herein by reference.

FIELD OF THE INVENTION

The present invention relates to agitating apparatus for a surface treating appliance, and to a cleaner head for a surface treating appliance. In its preferred embodiment, the present invention relates to a cleaner head for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening. The dirt-bearing air is conveyed to the separating apparatus so that dirt and dust can be separated from the air before the air is expelled to the atmosphere.

The suction opening is directed downwardly to face the floor surface to be cleaned. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the cleaner head so as to protrude to a small extent from the suction opening. The brush bar is activated mainly when the vacuum cleaner is used to clean carpeted surfaces. The brush bar comprises an elongate cylindrical core bearing bristles which extend radially outward from the core. The brush bar may be driven by an air turbine or by an electric motor powered by a power supply derived from the main body of the cleaner. The brush bar may be driven by the motor via a drive belt, or may be driven directly by the motor, so as to rotate within the suction opening. Rotation of the brush bar causes the bristles to sweep along the surface of the carpet to be cleaned to loosen dirt and dust, and pick up debris. The suction of air causes air to flow underneath the sole plate and around the brush bar to help lift the dirt and dust from the surface of the carpet and then carry it from the suction opening through the cleaner head towards the separating apparatus.

The bristles of the brush bar are usually formed from nylon. While the use of nylon bristles provides an acceptable cleaning performance on carpeted floor surfaces, we have found that the use of nylon bristles generates static electricity when the floor tool is used on some hard floor surfaces, such as laminate, wood and vinyl surfaces, which attracts fine dust and powders, such as talcum powder, on to the floor surface. This can impair the cleaning performance on the cleaner head on such floor surfaces, as the sweeping action of the nylon bristles is insufficient to overcome the force attracting the fine dust to the floor surface.

SUMMARY OF THE INVENTION

In a first aspect, the present invention provides agitating apparatus for a surface treating appliance, comprising a rotatable body having at least one substantially continuous row of bristles extending outwardly therefrom, the bristles having a surface resistivity in the range from $1\times10^{-5}$ to $1\times10^{12}$ Ω/sq.

Providing the rotatable body with bristles having a surface resistivity of the agitating means is preferably in the range from $1\times10^{-5}$ to $1\times10^{12}$ Ω/sq (ohms per square) can enable static electricity residing on a floor surface to be cleaned to be discharged upon contact between the bristles and the floor surface. Values of surface resistivity discussed herein are as measured using the test method ASTM D257. This enables fine dust and powder which would otherwise be attracted to the floor surface to be dislodged from the floor surface by the bristles. The bristles are preferably arranged in at least one substantially continuous row so that no patterns of dirt or dust are formed on the floor surface as each row of bristles is swept thereover.

The bristles are preferably formed from one of metallic, carbon fiber, carbon composite, conductive acrylic fibers such as Thunderon® fibers or other composite material. For example, material comprising carbon particles and carbon fibers generally has a surface resistivity in the range from $1\times10^{3}$ to $1\times10^{6}$ Ω/sq, whereas metallic material generally has a much lower surface resistivity, generally lower than 1 Ω/sq. Other static dissipative materials generally have a surface resistivity in the range from $1\times10^{5}$ to $1\times10^{12}$ Ω/sq.

The at least one row of bristles may be arranged in any desired pattern, or randomly, on the body. In a preferred embodiment, the bristles are arranged in at least one helical formation along the body.

The bristles are preferably arranged in a plurality of rows along the body. The bristles are arranged in a closely packed formation so that the, or each, row of bristles is substantially continuous. For example, each row of bristles preferably contains in the range from 20 to 100 bristles per mm length, and preferably has a thickness in the range from 0.25 to 2 mm. The diameter of each bristle is preferably in the range from 5 to 20 μm.

At least two rows of the bristles may be in electrical contact. In one embodiment, adjacent rows of bristles are in electrical contact. For example, a continuous row of bristles may be sandwiched between the rotatable body and a connecting member connected to the body so that the ends of the bristles protrude from the body to define respective rows of bristles. This can simplify manufacture of the agitating apparatus, and reduce costs.

In a preferred embodiment the rotatable body comprises further surface agitating means. The agitating apparatus may thus comprise two different surface agitating means. Preferably, the bristles protrude radially outwardly from the body beyond the further surface agitating means. The relatively short, further surface agitating means may be configured to agitate dirt and dust from a carpeted floor surface, whereas the relatively long bristles may be configured to sweep dirt and dust from a hard floor surface. The further surface agitating means is thus preferably relatively stiff in comparison to the bristles. For example, the bristles may have a smaller diameter than bristles or filaments of the further surface agitating means. For example, the further surface agitating means may be formed from bristles having a diameter in the range from 100 to 200 μm.

The further surface agitating means may be formed from electrically insulating, plastics material, such as nylon, and so may have a surface resistivity which is different to that of the bristles. The surface resistivity of the further surface agitating means is preferably in the range from $1\times10^{12}$ to $1\times10^{16}$ Ω/sq. Alternatively, the further surface agitating means may be formed from a similar material as the bristles, and so may have a surface resistivity within the aforementioned range for the bristles, in order to discharge any static electricity residing on a carpeted floor surface.

The further surface agitating means is preferably spaced from the bristles. The further surface agitating means is preferably arranged in a plurality of rows along the body, with these rows being preferably discontinuous. For example, where the further surface agitating means comprises a plurality of bristles these bristles are preferably arranged in one or more rows of clusters or tufts of bristles connected to and spaced along the body. However, the further surface agitating means may be located within, or otherwise in contact with, the continuous row of bristles.

Preferably, the continuous row of bristles protrudes outwardly beyond the further surface agitating means by a distance in the range from 0.5 to 5 mm, more preferably by a distance in the range from 1 to 3 mm.

The agitating apparatus is preferably in the form of a rotatable brush bar. Alternatively, the body may be in the form of a disc or plate.

In a second aspect, the present invention provides a cleaner head for a surface treating appliance, the cleaner head comprising a housing and apparatus as aforementioned. The cleaner head preferably comprises a sole plate having a suction opening through which dirt-bearing air enters the cleaner head, and through which the bristles protrude as the body is rotated during use of the cleaner head, and a plurality of support members, preferably in the form of rolling elements, such as wheels or rollers, rotatably mounted on the sole plate, for supporting the cleaner head on a surface to be cleaned.

In a third aspect, the present invention provides a surface treating appliance comprising a cleaner head or agitating apparatus as aforementioned.

The term "surface treating appliance" is intended to have a broad meaning, and includes a wide range of machines having a main body and a head for travailing over a surface to clean or treat the surface in some manner. It includes, inter alia, machines which simply agitate the surface, such as carpet sweepers, machines which only apply suction to the surface, such as vacuum cleaners (dry, wet and wet/dry), so as to draw material from the surface, and machines which apply material to the surface, such as polishing/waxing machines, pressure washing machines and shampooing machines.

Features described above in connection with the first aspect of the invention are equally applicable to any of the second to third aspects of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
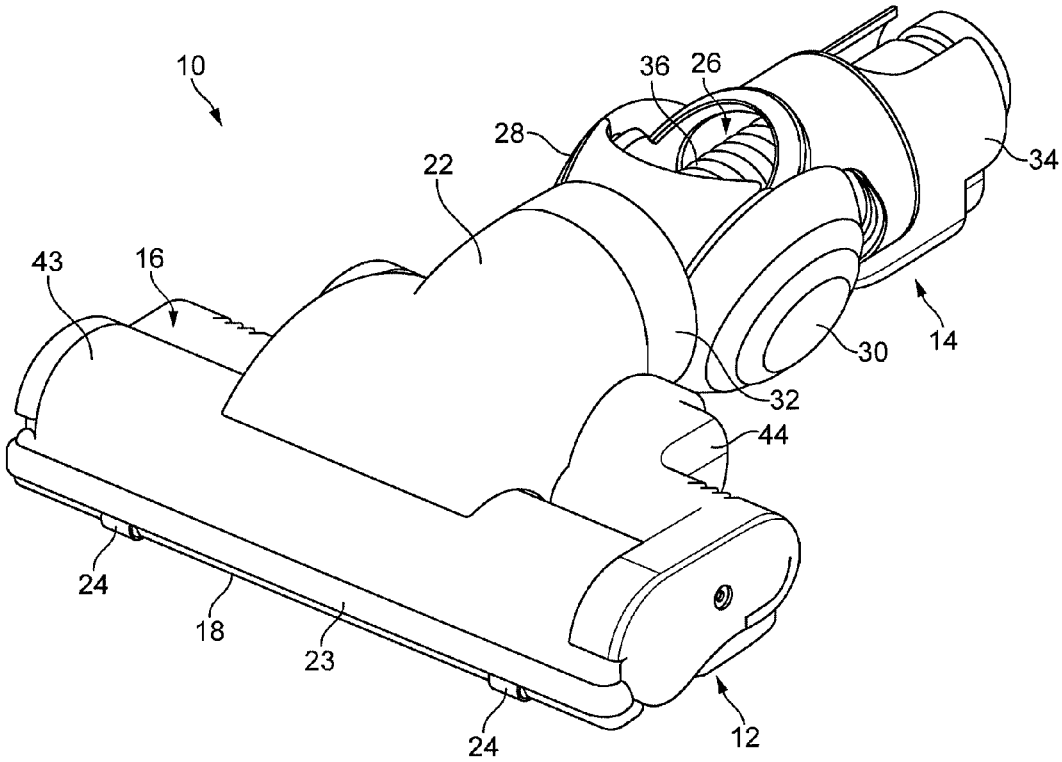
FIG. 1 is a front perspective view, from above, of a floor tool.
Figure 2:
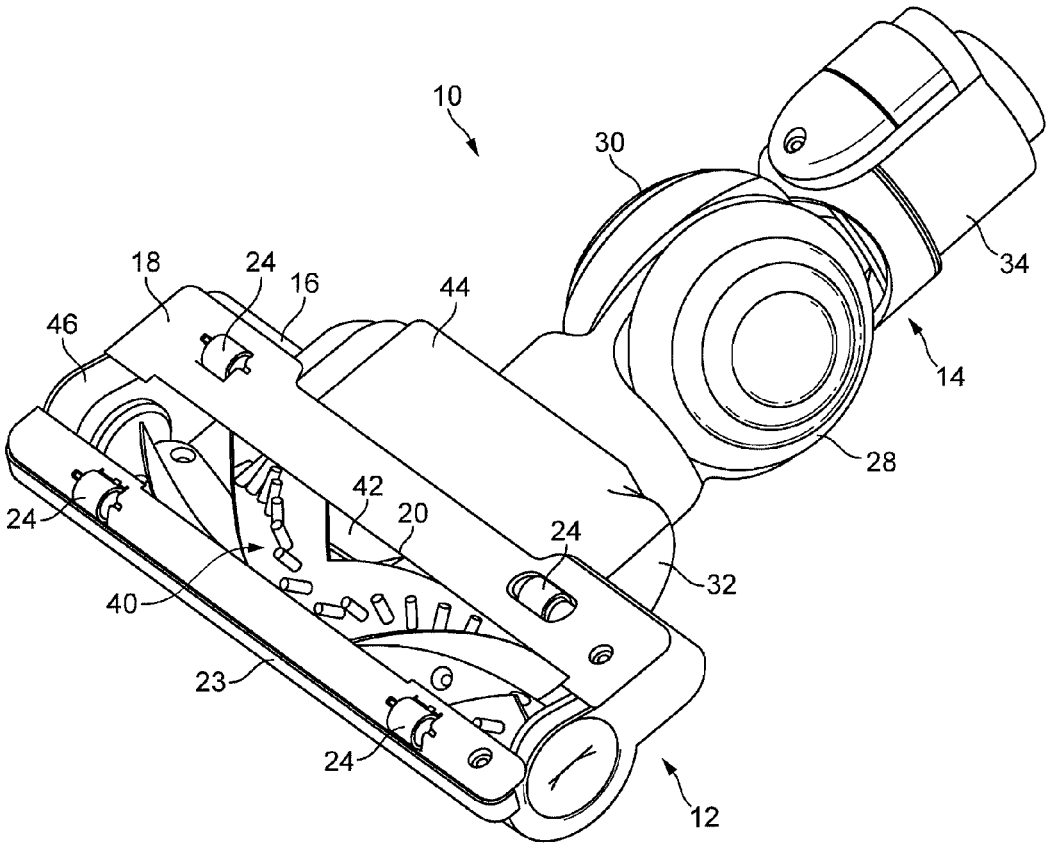
FIG. 2 is a front perspective view, from below, of the floor tool of FIG. 1.
Figure 3:
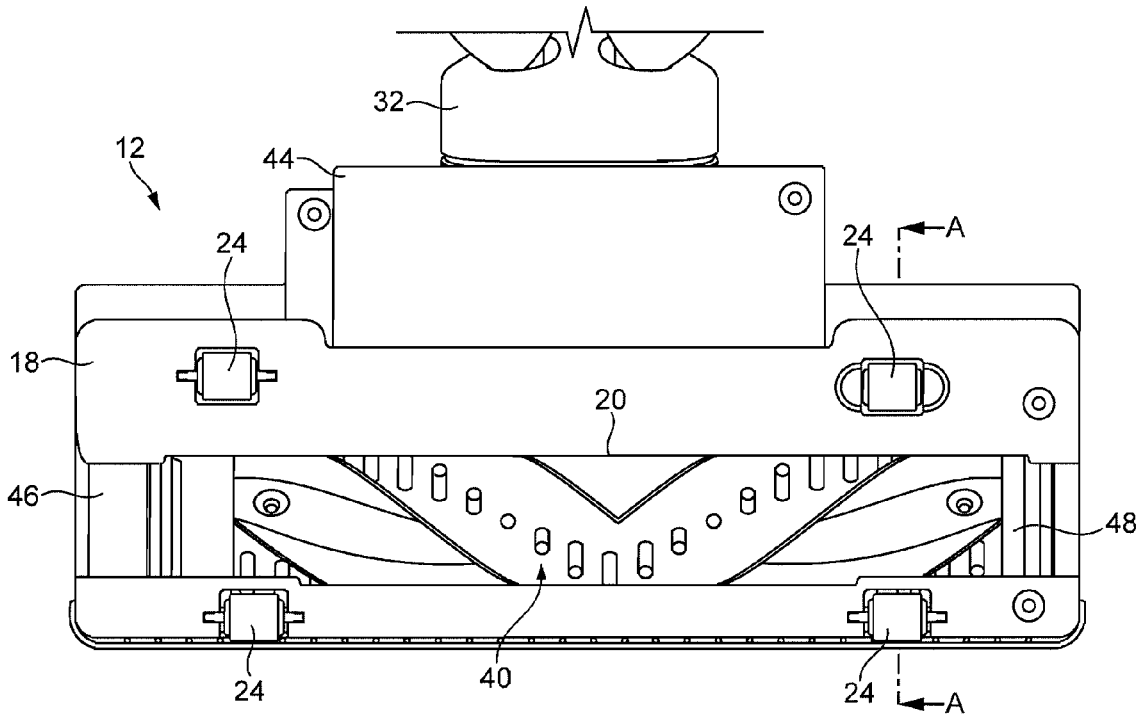
FIG. 3 is a bottom view of the floor tool of FIG. 1.
Figure 7:
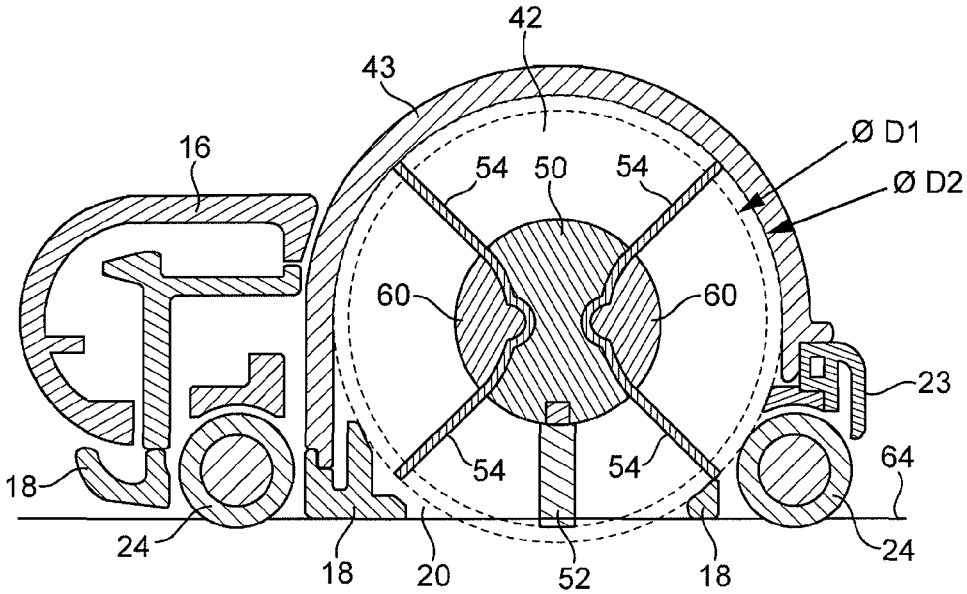
FIG. 7 is a section taken along line A-A illustrated in FIG. 3 when the floor tool is located on a carpeted floor surface.
Figure 8:
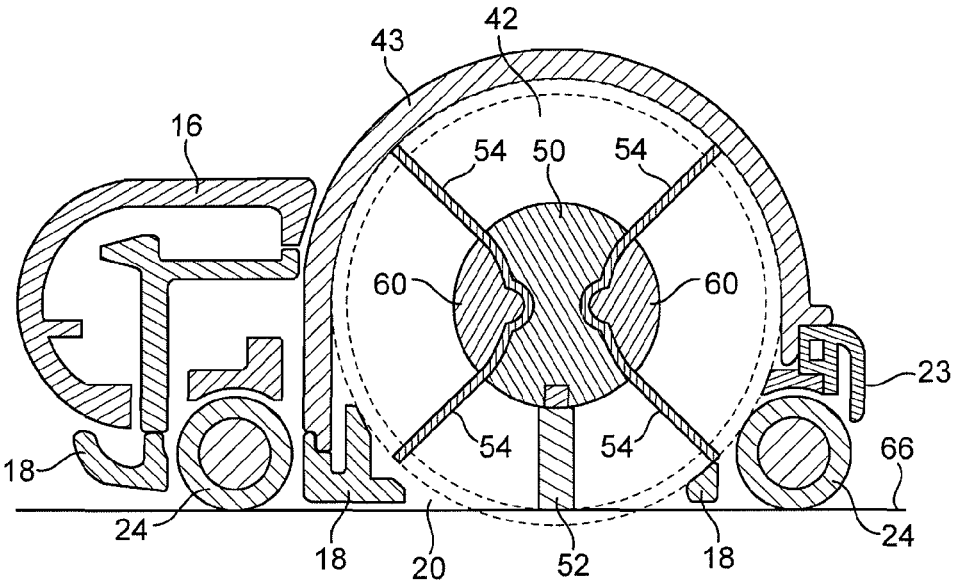
FIG. 8 is a section taken along line A-A illustrated in FIG. 3 when the floor tool is located on a hard floor surface.

With reference first to FIGS. 1 to 3, a floor tool 10 comprises a cleaner head 12 rotatably attached to a coupling 14. The free end of the coupling 14 is attachable to a wand, hose or other such duct of a cleaning appliance (not shown). The cleaner head 12 comprises a housing 16 and a lower plate, or sole plate 18, comprising a suction opening 20 through which a dirt-bearing fluid flow enters the cleaner head 12. The housing 16 defines a suction passage extending from the suction opening 20 to an outlet duct 22 located at the rear of the housing 16. The housing 16 preferably comprises a front bumper 23. The sole plate 18 comprises a plurality of support members 24 in the form of rolling elements mounted within recessed portions of the sole plate 18 for supporting the cleaner head 12 on a floor surface. With reference to FIGS. 7 and 8, the support members 24 are preferably arranged to support the sole plate 18 above the floor surface when the cleaner head 12 is located on a hard floor surface 66, and, when the cleaner head 12 is located on a carpeted floor surface 64, to sink into the pile of the carpet to enable the bottom surface of the sole plate 18 to engage the fibers of the carpet. The sole plate 18 is preferably pivotable relative to the housing 16 to allow the sole plate 18 to ride smoothly over the carpeted floor surface 64 during cleaning.

The coupling 14 comprises a conduit 26 supported by a pair of wheels 28, 30. The conduit 26 comprises a forward portion 32 connected to the outlet duct 22, a rearward portion 34 pivotably connected to the forward portion 32 and connectable to a wand, hose or other such duct of a cleaning appliance which comprises dirt and dust separating apparatus and a motor-driven fan unit for drawing dirt-bearing air through the suction opening 20 from the floor surface. A flexible hose 36 is held within and extends between the forward and the rearward portions 32, 34 of the conduit 26.

The cleaner head 12 comprises agitating apparatus for agitating dirt and dust located on the floor surface. In this example the agitating apparatus comprises a rotatable brush bar 40 which is mounted within a brush bar chamber 42 of the housing 16. The brush bar chamber 42 is partially defined by a generally semi-cylindrical portion 43 of the housing 16, which is preferably formed from transparent material. The brush bar 40 is driven by a motor (not shown) located in a motor housing 44 of the housing 16. The motor is electrically connected to a terminal located in the rearward portion 34 of the conduit 26 for connection with a conformingly profiled terminal located in a duct of the cleaning appliance to enable electrical power to be supplied to the motor.

The brush bar 40 is connected to the motor by a drive mechanism located, at least in part, within a drive mechanism housing 46 so that the drive mechanism is isolated from the air passing through the suction passage. One end of the brush bar 40 is connected to the drive mechanism to enable the brush bar 40 to be driven by the motor, whereas the other end of the brush bar 40 is rotatably supported by an end cap 48 mounted on a side wall of the brush bar chamber 42.

Figure 4:
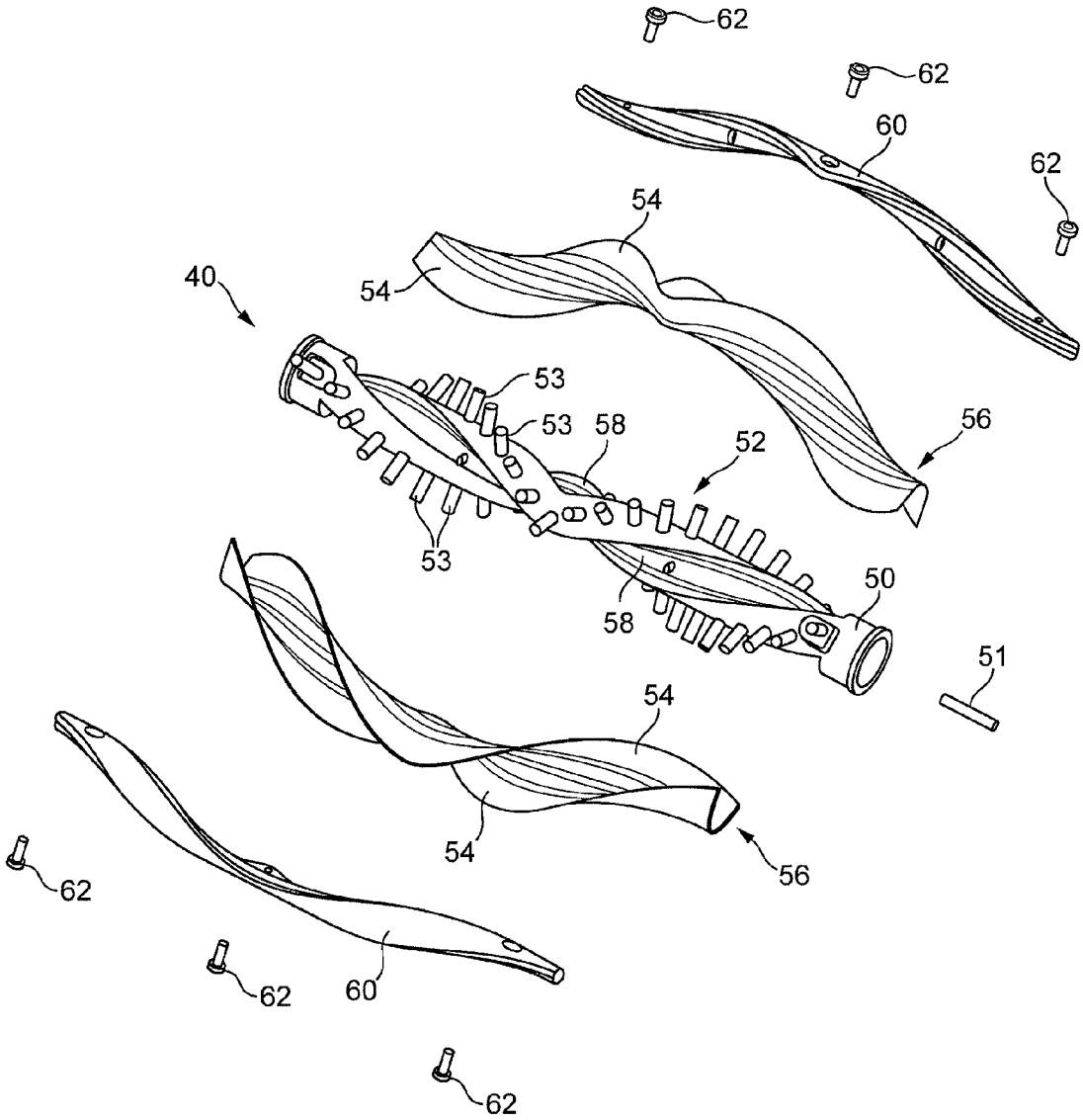
FIG. 4 is an exploded view of the brush bar of the floor tool of FIG. 1.
Figure 5:
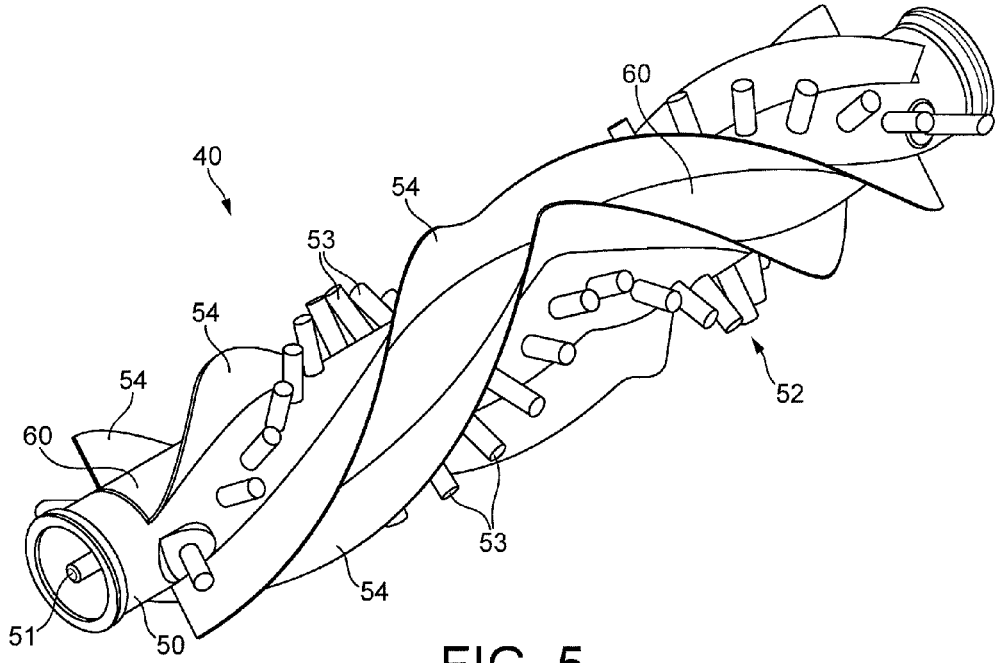
FIG. 5 is a perspective view of the brush bar of FIG. 4.
Figure 6:
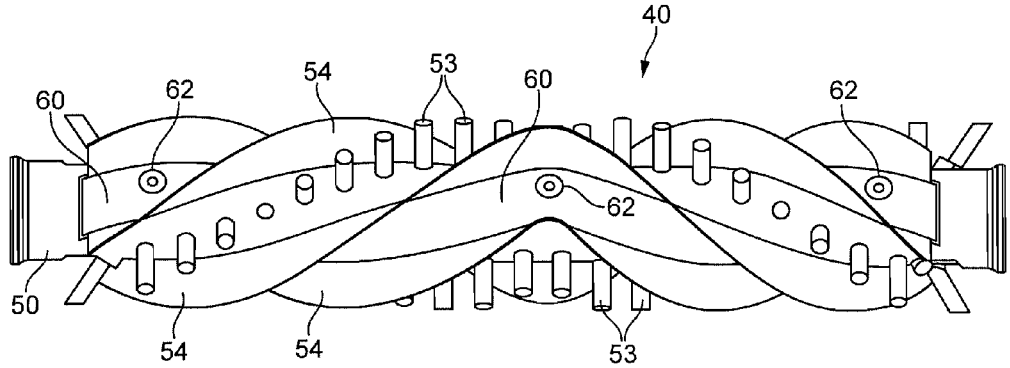
FIG. 6 is a top view of the brush bar of FIG. 4.

The brush bar 40 is illustrated in more detail in FIGS. 4 to 6. The brush bar 40 comprises an elongate body 50 bearing two different types of agitating means for agitating dirt and dust from the floor surface as the brush bar 40 is rotated by the motor. Each of the different types of agitating means protrudes from the suction opening 20 in the sole plate 18 as the brush bar 40 is rotated by the motor. A spindle 51 is mounted on one end of the body 50, with the spindle 51 being in turn connected to the end cap 48.

A first agitating means mounted on the body 50 of the brush bar 40 comprises relatively short, preferably relatively stiff, bristles 52. These bristles 52 are preferably formed from nylon. In this embodiment the relatively short bristles 52 are arranged in two angularly spaced, helical rows extending along the body 50. Within each row, the relatively short bristles 52 are arranged in a series of clusters or tufts 53 regularly spaced along the row. Each tuft 53 preferably comprises around 100 to 150 bristles, with each tuft 53 having a diameter in the range from 2 to 4 mm. The diameter of each bristle 52 is preferably in the range from 100 to 200 μm. The length of the relatively short bristles 52 is chosen so that, when the floor tool 50 is assembled, the tips of these bristles 52 do not protrude beneath a plane extending between the lowermost extremities of the support members 24 during rotation of the brush bar 40.

A second agitating means mounted on the body 50 of the brush bar 40 comprises relatively long, preferably relatively soft, bristles 54. As illustrated in FIG. 7, the relatively long bristles 54 protrude radially outwardly from the body 50 beyond the relatively short bristles 52. During rotation of the body 50, the relatively short bristles 52 sweep a cylindrical volume having a diameter D1, whereas the relatively long bristles 54 sweep a cylindrical volume having a diameter D2 which is greater than D1. The difference between D1 and D2 is preferably in the range from 1 to 10 mm, more preferably in the range from 2 to 6 mm. In contrast to the relatively short bristles 52, the length of the relatively long bristles 54 is chosen so that the relatively long bristles 54 protrude beyond the plane extending between the lowermost extremities of the support members 24 during rotation of the brush bar 40.

The relatively long bristles 54 are formed from material having a lower surface resistivity than the material from which the relatively short bristles 52 are formed. The surface resistivity of the relatively long bristles 54 is preferably in the range from $1\times10^{-5}$ to $1\times10^{12}$ Ω/sq. In comparison, the surface resistivity of the relatively short bristles 52 is preferably higher than $1\times10^{12}$ Ω/sq. The relatively long bristles 54 may be formed from electrically conductive material. The bristles may be formed from metallic, graphite, conductive acrylic or other composite material, but in this example the relatively long bristles 54 comprise carbon fiber bristles. The diameter of each bristle 54 is preferably in the range from 5 to 20 μm.

The body 50 comprises a plurality of angularly spaced, continuous rows of the relatively long bristles 54, which preferably also extend helically along the body 50. In this embodiment the body 50 comprises four continuous rows of the relatively long bristles 54, with each row being angularly spaced from a row of tufts 53 formed from the relatively short bristles 52. Each row of the relatively long bristles 54 preferably contains in the range from 20 to 100 bristles per mm length, and has a thickness in the range from 0.25 to 2 mm.

With particular reference to FIG. 4, in this embodiment adjacent rows of the relatively long bristles 54 are formed from a single strip 56 of bristles. Each strip 56 is preferably formed by attaching an elongate, generally rectangular flexible carrier member to a row of bristles so that each row of bristles 54 protrudes outwardly from a respective long side edge of the carrier member. The carrier member may be attached to the row of bristles by stitching or by using an adhesive. Each strip 56 is then located within a respective helical groove 58 formed in the body 50 so that the ends of the bristles protrude outwardly from the body 50. The strips 56 are connected to the body 50 by helical connectors 60 which are mounted on the strips 56 and connected to the body 50 using screws 62 into apertures formed in the connectors 60. The screws 62 may be pushed through the carrier member, or inserted through apertures formed in the carrier member. An adhesive tape may be applied to at least one side of each carrier member to allow the strips 56 to be aligned within the grooves 58 so that the ends of the bristles protrude from the body 50 by a regular amount along the length of the body 50.

With reference to FIG. 7, when the cleaner head 12 is located on a carpeted floor surface 64 the support members 24 sink into the pile of the carpet so that the bottom surface of the sole plate 18 engages the fibers of the carpet. As both the relatively short bristles 52 and the relatively long bristles 54 protrude from the suction opening 20 as the brush bar 40 rotates, both the different types of bristles are able to agitate dirt and dust from the floor surface. When an air flow is generated through the suction passage of the cleaner head 12, this dirt and dust becomes entrained within the air flow and is conveyed through the floor tool 10 to the cleaning appliance.

When the cleaner head 12 is moved from the carpeted floor surface 64 on to a hard floor surface 66, as illustrated in FIG. 8, the sole plate 18 becomes spaced from the hard floor surface 66. As the tips of the relatively short bristles 52 do not protrude beneath the plane extending between the lowermost extremities of the support members 24, these bristles do not come into contact with the hard floor surface 66, thereby preventing scratching or other marking of the hard floor surface 66 by these bristles. However, as the relatively long bristles 54 protrude beyond this plane, these bristles engage, and are swept across, the hard floor surface 66 with rotation of the brush bar 40. Due to the relatively low surface resistivity of the relatively long bristles 54, any static electricity residing on the hard floor surface 66 is discharged upon contact with the relatively long bristles 54, thereby enabling fine dust and powder which would otherwise be attracted to the hard floor surface 66 to be dislodged from the floor surface by these bristles and entrained within the air flow.

The invention is not limited to the detailed description given above. Variations will be apparent to the person skilled in the art.

For example, in the embodiment described above, the cleaner head 12 includes a brush bar 40 that is driven by a motor. However, the cleaner head 12 may include alternative means for agitating or otherwise working a surface to be cleaned. By way of example, the brush bar 40 may be driven by an air turbine rather than a motor.

The relatively short bristles 52 may be formed from similar material as the relatively long bristles 54 in order to discharge any static material residing on a carpeted floor surface, and so may also have a surface resistivity in the range from $1\times10^{-5}$ to $1\times10^{12}$ Ω/sq.

Figure 9:
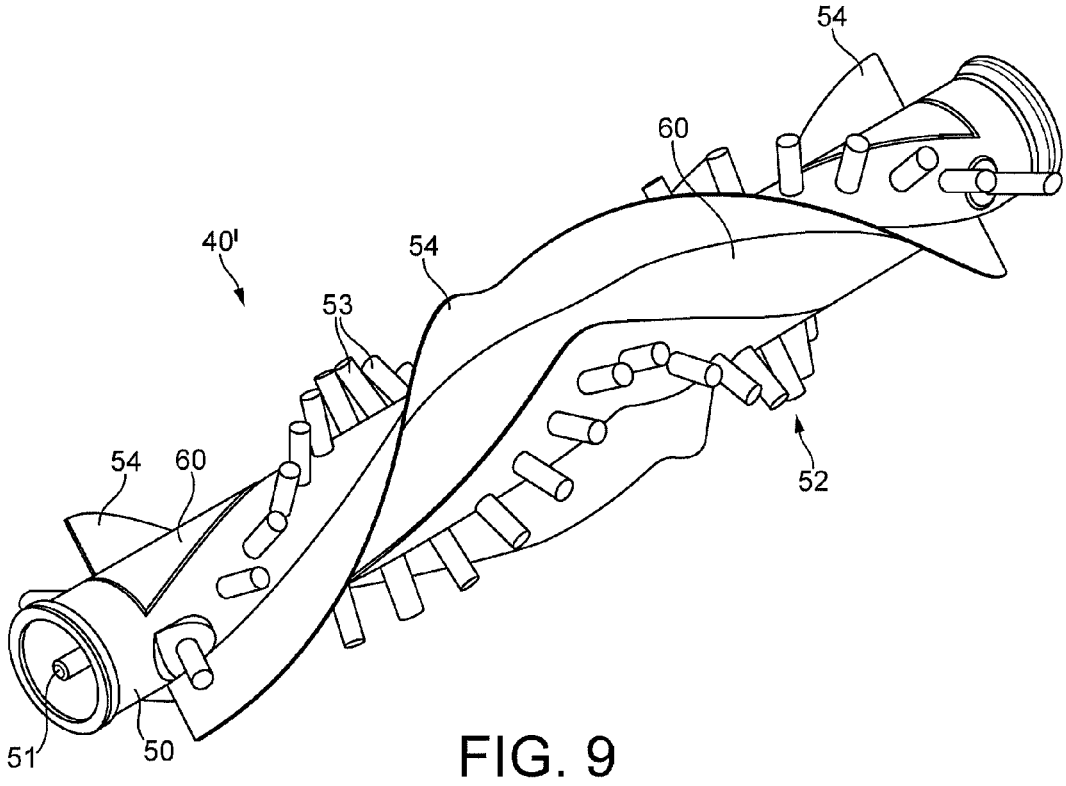
FIG. 9 is a perspective view of a modified version of the brush bar of FIG. 4.

Each strip 56 may be modified so that the bristles protrude from only one of the relatively long side edges of the carrier member. Thus, each strip 56 may be in the form of a brush, with bristles extending outwardly from only one side of the brush. A modified version of the brush bar 40', in which each strip 56 has been modified as discussed above, is illustrated in FIG. 9. This modification of the strips 56 results in the bristles 54 protruding outwardly from one side only of each connecting member 60. Consequently, this brush bar 40' contains only two continuous rows of relatively long bristles 54, with the rows of tufts 53 and the rows of relatively long bristles 54 being alternately arranged about the body 50 of the brush bar 40'. As with the brush bar 40, the relatively long bristles 54 protrude radially outwardly from the body 50 beyond the relatively short bristles 52.

The different types of bristles 52, 54 need not be spaced apart. The brush bar 40 may comprise a plurality of rows, clumps or tufts of bristles, with each row, clump or tuft comprising both types of bristles. For example, relatively short bristles 52 may be dispersed within each row of relatively long bristles 54. Alternatively, relatively long bristles 54 may be dispersed within each tuft 53 of relatively short bristles 52.

The agitating means may take forms other than bristles, such as flexible or rigid strips of material mounted on the body 50, or filaments sewn into a backing material connected to the body 50.

In the event that the floor tool 10 is not to be used on a carpeted surface, the relatively short bristles 52 may be dispensed with so that the brush bar 40 comprises only electrically conductive agitating members. Consequently, the brush bar 40 may comprise solely the continuous rows of surface agitating members defined by the relatively long bristles 54 illustrated in FIGS. 2 to 8. Alternatively, the brush bar 40 may comprise a different arrangement of surface agitating members for discharging static electricity residing on a floor surface.

Figure 10:
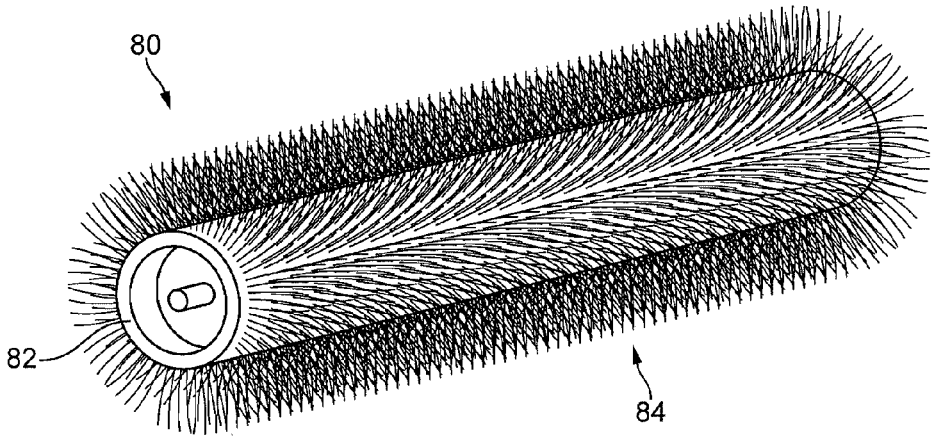
FIG. 10 is a perspective view of an alternative brush bar for use with the floor tool of FIG. 1.

For example, with reference to FIG. 10 an alternative brush bar 80 for use in the floor tool 10 comprises a rotatable body 82 having an outer surface comprising an electrically conductive pile 84. In this example, the pile 84 is similar to the raised or fluffy surface of a carpet, rug or cloth, and comprises filaments woven on to a fabric carrier member 86 attached to the body 82, for example using an adhesive. The length of the filaments of the pile 84 is preferably in the range from 4 to 15 mm, and the filaments have a diameter which is preferably in the range from 5 to 20 μm.

These filaments are preferably formed from carbon fibers, but alternatively they may be formed from metallic material, conductive acrylic material or other composite material. Consequently, the surface resistivity of the filaments of the pile 84 is preferably in the range from $1\times10^{-5}$ to $1\times10^{12}$ Ω/sq. The fabric carrier member 86 may be in the form of a strip wound on to the body 82 so that the pile 84 is substantially continuous, substantially covering the outer surface of the body 82. Alternatively, the carrier member 86 may be in the form of a cylindrical sleeve into which the body 82 is inserted.

If so desired, clumps of relatively stiff bristles may be dispersed within the pile 84. Alternatively, a strip of the pile 84 may be wound around one or more helical rows of relatively stiff bristles previously attached to the body 82. These bristles may be similar to the relatively short bristles 52 of the brush bar 40, and so may be arranged so as to not protrude radially outwardly beyond the filaments of the pile 84.

The invention claimed is:

1. A floor tool for a surface treating appliance, comprising a suction opening through which a dirt-bearing fluid flow enters the floor tool, and an agitating apparatus comprising a rotatable body, wherein the rotatable body comprises at least one continuous row of carbon fiber bristles extending outwardly from a groove formed in the body and comprises further surface agitating members of a type different than carbon fiber bristles and formed from electrically insulating material, the further surface agitating members being discontinuous.

2. The floor tool of claim 1, wherein said at least one continuous row is helical.

3. The floor tool of claim 1, wherein said at least one continuous row comprises a plurality of continuous rows along the body.

4. The floor tool of claim 1, wherein the bristles have a diameter in the range from 5 to 20 μm.

5. The floor tool of claim 1, wherein each row of bristles contains in the range from 20 to 100 bristles per mm length.

6. The floor tool of claim 1, wherein a surface resistivity of the further surface agitating members is different than a surface resistivity of the bristles.

7. The floor tool of claim 1, wherein a stiffness of the further surface agitating members is different than a stiffness of the bristles.

8. The floor tool of claim 1, wherein the further surface agitating members are arranged in at least one helical formation along the body.

9. The floor tool of claim 1, wherein the further surface agitating members are arranged in a plurality of rows along the body.

10. The floor tool of claim 9, wherein the further surface agitating members comprise bristles or filaments.

11. The floor tool of claim 1, wherein the further surface agitating members comprise one of a plurality of bristles, a plurality of filaments, and at least one strip of material.

12. The floor tool of claim 1, wherein the agitating apparatus comprises a rotatable brush bar.

13. The floor tool of claim 1, comprising a sole plate having the suction opening, and a plurality of support members mounted on the sole plate for supporting the cleaner head on a surface to be cleaned.

* * * * *